US010336588B2

(12) United States Patent
Yoda

(10) Patent No.: US 10,336,588 B2
(45) Date of Patent: Jul. 2, 2019

(54) MOBILE CRANE

(71) Applicant: TADANO LTD., Takamatsu (JP)

(72) Inventor: Motoo Yoda, Takamatsu (JP)

(73) Assignee: TADANO LTD., Kagawa (JP)

( * ) Notice: Subject to any disclaimer, the term of this patent is extended or adjusted under 35 U.S.C. 154(b) by 326 days.

(21) Appl. No.: 15/509,106

(22) PCT Filed: Sep. 9, 2015

(86) PCT No.: PCT/JP2015/075661
§ 371 (c)(1),
(2) Date: Mar. 6, 2017

(87) PCT Pub. No.: WO2016/092923
PCT Pub. Date: Jun. 16, 2016

(65) Prior Publication Data

US 2017/0275142 A1 Sep. 28, 2017

(30) Foreign Application Priority Data

Dec. 9, 2014 (JP) ..... 2014-249230

(51) Int. Cl.
*B66C 23/82* (2006.01)
*B66C 23/34* (2006.01)
(Continued)

(52) U.S. Cl.
CPC ..... *B66C 23/344* (2013.01); *B66C 23/26* (2013.01); *B66C 23/42* (2013.01); *B66C 23/702* (2013.01);
(Continued)

(58) Field of Classification Search
CPC ..... B66C 23/26; B66C 23/34; B66C 23/344; B66C 23/42; B66C 23/702; B66C 23/82;
(Continued)

(56) References Cited

U.S. PATENT DOCUMENTS 3,246,769 A * 4/1966 Noll ..... B66C 23/26 212/295
4,383,616 A * 5/1983 Sterner ..... B66C 23/702 212/296
(Continued)

FOREIGN PATENT DOCUMENTS

JP H07215672 A 8/1995
JP H11-322277 A 11/1999
(Continued)

OTHER PUBLICATIONS

International Search Report issued in PCT/JP2015/075661 dated Dec. 22, 2015.
Written Opinion issued in PCT/JP2015/075661 dated Dec. 22, 2015.

*Primary Examiner* — Michael R Mansen
*Assistant Examiner* — Nathaniel L Adams
(74) *Attorney, Agent, or Firm* — Marshall, Gerstein & Borun LLP

(57) ABSTRACT

A mobile crane is configured so that a boom is raised by a derrick cylinder in response to a raise signal output from a derrick lever and the derrick cylinder is stopped in response to the derrick angle of the boom reaching the maximum angle γ corresponding to the hoisted-down length of a rope.

8 Claims, 12 Drawing Sheets

(51) Int. Cl.

| | |
|---|---|
| ***B66C 23/26*** | (2006.01) |
| ***B66C 23/42*** | (2006.01) |
| ***B66C 23/88*** | (2006.01) |
| ***B66C 23/70*** | (2006.01) |

(52) U.S. Cl.
CPC ..... *B66C 23/82* (2013.01); *B66C 23/823* (2013.01); *B66C 23/88* (2013.01); *B66C 2700/0357* (2013.01); *B66C 2700/0392* (2013.01)

(58) Field of Classification Search
CPC ..... B66C 23/823; B66C 2700/0392; B66C 23/0357
See application file for complete search history.

(56) References Cited

U.S. PATENT DOCUMENTS

| | | | | |
|---|---|---|---|---|
| 7,341,158 | B2 * | 3/2008 | Toudou | B66C 23/344 212/239 |
| 2010/0252522 | A1 * | 10/2010 | Conrad | B66C 23/82 212/177 |
| 2012/0312767 | A1 * | 12/2012 | Bohnacker | B66C 13/46 212/276 |

FOREIGN PATENT DOCUMENTS

| | | | |
|---|---|---|---|
| JP | H11-322278 | A | 11/1999 |
| JP | 3257508 | B2 | 2/2002 |
| JP | 2007-204236 | A | 8/2007 |

* cited by examiner

FIG.3

| BOOM LENGTH $\alpha$ | HOISTED-DOWN LENGTH $\beta$ | DERRICK ANGLE $\gamma$ |
|---|---|---|
| $\alpha 1$ | $\beta 11$ | $\gamma 11$ |
| | $\beta 12$ | $\gamma 12$ |
| | $\beta 13$ | $\gamma 13$ |
| | ⋮ | ⋮ |
| $\alpha 2$ | $\beta 21$ | $\gamma 21$ |
| | $\beta 22$ | $\gamma 22$ |
| | $\beta 23$ | $\gamma 23$ |
| | ⋮ | ⋮ |
| $\alpha 3$ | $\beta 31$ | $\gamma 31$ |
| | $\beta 32$ | $\gamma 32$ |
| | $\beta 33$ | $\gamma 33$ |
| | ⋮ | ⋮ |
| ⋮ | ⋮ | ⋮ |

FIG.4

| BOOM LENGTH $\alpha$ | DERRICK ANGLE $\gamma$ | HOISTED-DOWN LENGTH $\beta$ |
|---|---|---|
| $\alpha_4$ | $\gamma_{41}$ | $\beta_{41}$ |
| | $\gamma_{42}$ | $\beta_{42}$ |
| | $\gamma_{43}$ | $\beta_{43}$ |
| | ⋮ | ⋮ |
| $\alpha_5$ | $\gamma_{51}$ | $\beta_{51}$ |
| | $\gamma_{52}$ | $\beta_{52}$ |
| | $\gamma_{53}$ | $\beta_{53}$ |
| | ⋮ | ⋮ |
| $\alpha_6$ | $\gamma_{61}$ | $\beta_{61}$ |
| | $\gamma_{62}$ | $\beta_{62}$ |
| | $\gamma_{63}$ | $\beta_{63}$ |
| | ⋮ | ⋮ |
| ⋮ | ⋮ | ⋮ |

MOBILE CRANE

TECHNICAL FIELD

The present disclosure relates to a mobile crane to/from which a luffing jib can be attached and removed.

BACKGROUND

Heretofore, a mobile crane to/from which a luffing jib can be attached and removed is known. The luffing jib extends the workable range of the mobile crane by being attached to the tip of a boom of the mobile crane. Japanese Patent No. 3257508 describes a procedure of attaching the luffing jib to the mobile crane.

According to Japanese Patent No. 3257508, the luffing jib placed on the ground is first connected to the tip of a boom. Next, a jib derrick winch is hoisted up, so that a front post and a rear post are raised to reach predetermined rotation angles. Next, a boom derrick winch is hoisted up, so that a boom is raised to reach a predetermined derrick angle. Then, the jib derrick winch is further hoisted up, so that the luffing jib is raised to reach a predetermined tilt angle.

As described also in Japanese Patent No. 3257508, when the operation is not carried out according to the above-described procedure, the constituent parts of the mobile crane may be damaged. For example, when a boom 22 is raised in a state where a first mast 39 and a second mast 40 are not sufficiently raised as illustrated in FIG. 11 and FIG. 12, the second mast 40 and a rope 44 are substantially in parallel to each other and the second mast 40 is rotatable with respect to a support 38.

Then, when the boom 22 is further raised from the state illustrated in FIG. 12, the first mast 39 and the second mast 40 may fall down to the luffing jib 30 side. In this case, when the tilt angle (angle formed by the boom 22 and the luffing jib 30) of the luffing jib 30 is large, the luffing jib 30 (a base jib 31 in more detail) may be damaged by the fallen-down second mast 40.

SUMMARY OF THE DISCLOSURE

The presently described embodiments have been made in view of the above-described circumstances. It is an object of the present disclosure to provide a mobile crane configured so as to prevent breakage of a luffing jib during a derrick operation of a boom or the luffing jib.

(1) A mobile crane according to one embodiment described herein has a base vehicle, a slewing base slewably supported by the base vehicle, a boom derrickably supported by the slewing base, a derrick cylinder raising and lowering the boom, a jib support removably attached to the tip of the boom, a luffing jib derrickably supported by the jib support, a first mast rotatably supported by the jib support or the luffing jib, a second mast rotatably supported by the jib support, a first tension link connecting the luffing jib and the first mast to each other, a second tension link connecting the first mast and the second mast to each other, a winch hoisting down a rope connected to the second mast to rotate the second mast to the side of the luffing jib and hoisting up the rope to rotate the second mast to a side opposite to the luffing jib, an operating unit outputting a signal according to a user operation of raising and lowering the boom, and a control unit controlling the operation of the derrick cylinder and the winch. The control unit causes the derrick cylinder to raise the boom in response to the signal output from the operating unit and stops the derrick cylinder in response to the derrick angle of the boom reaching the maximum angle corresponding to the hoisted-down length of the rope.

According to the configuration described above, the boom is prevented from being raised exceeding the maximum angle corresponding to the hoisted-down length of the rope. As a result, the luffing jib is prevented from being damaged by the second mast falling down to the side of the luffing jib.

(2) Preferably, the control unit reports that it is necessary to hoist up the rope in response to the derrick angle of the boom reaching the maximum angle.

According to the configuration described above, a worker can be urged to perform an operation for avoiding damages to the luffing jib. As a result, damages to the luffing jib can be more effectively suppressed.

(3) For example, the mobile crane further has a storage unit storing the maximum angle set for each hoisted-down length of the rope.

However, a method for the mobile crane to hold the maximum angle is not limited thereto. For example, the control unit may use a function by which the maximum angle is output by inputting the hoisted-down length of the rope.

(4) Preferably, the boom is telescopic. The control unit stops the derrick cylinder in response to the derrick angle of the boom reaching the maximum angle corresponding to a combination of the hoisted-down length of the rope and the length of the boom.

According to the configuration described above, the luffing jib can be more effectively prevented from being damaged by the second mast falling down to the side of the luffing jib.

(5) A mobile crane according to another embodiment described herein has a base vehicle, a slewing base slewably supported by the base vehicle, a boom derrickably supported by the slewing base, a derrick cylinder raising and lowering the boom, a jib support removably attached to the tip of the boom, a luffing jib derrickably supported by the jib support, a first mast rotatably supported by the jib support or the luffing jib, a second mast rotatably supported by the jib support, a first tension link connecting the luffing jib and the first mast to each other, a second tension link connecting the first mast and the second mast to each other, a winch hoisting down a rope connected to the second mast to rotate the second mast to the side of the luffing jib and hoisting up the rope to rotate the second mast to a side opposite to the luffing jib, an operating unit outputting a signal according to a user operation of hoisting down the rope, and a control unit controlling the operation of the derrick cylinder and the winch. The control unit causes the winch to hoist down the rope in response to the signal output from the operating unit and stops the winch in response to the hoisted-down length of the rope reaching the maximum length corresponding to the derrick angle of the boom.

According to the configuration described above, the winch is prevented from hoisting down the rope exceeding the maximum length corresponding to the derrick angle of the boom. As a result, the luffing jib can be prevented from being damaged by the second mast falling down to the side of the luffing jib.

(6) Preferably, the control unit reports that it is necessary to make the boom fall down in response to the hoisted-down length of the rope reaching the maximum length.

According to the configuration described above, a worker can be urged to perform an operation for avoiding damages to the luffing jib. As a result, damages to the luffing jib can be more effectively suppressed.

(7) For example, the mobile crane further has a storage unit storing the maximum length set for each derrick angle of the boom.

However, a method for the mobile crane to hold the maximum length is not limited thereto. For example, the control unit may use a function by which the maximum length is output by inputting the derrick angle of the boom.

(8) Preferably, the boom is telescopic. The control unit stops the winch in response to the hoisted-down length of the rope reaching the maximum length corresponding to a combination of the derrick angle of the boom and the length of the boom.

According to the configuration described above, the luffing jib can be more effectively prevented from being damaged by the second mast falling down to the side of the luffing jib.

According to the contemplated and described embodiments, a boom is prevented from being raised exceeding the maximum angle or a winch is prevented from hoisting down a rope exceeding the maximum length, and therefore the luffing jib can be prevented from being damaged by the second mast falling down to the side of the luffing jib.

BRIEF DESCRIPTION OF DRAWINGS

FIG. 3 shows an example of the maximum angle table stored in a storage unit 62.

FIG. 4 shows an example of the maximum length table stored in the storage unit 62.

DETAILED DESCRIPTION

Hereinafter, a preferable embodiment is described with reference to the drawings as appropriate. It is a matter of course that this embodiment is only one aspect of the presently described embodiments and may be altered insofar as the scope of the contemplated embodiments is not altered.

[Outline of Mobile Crane 100]

Figure 1:
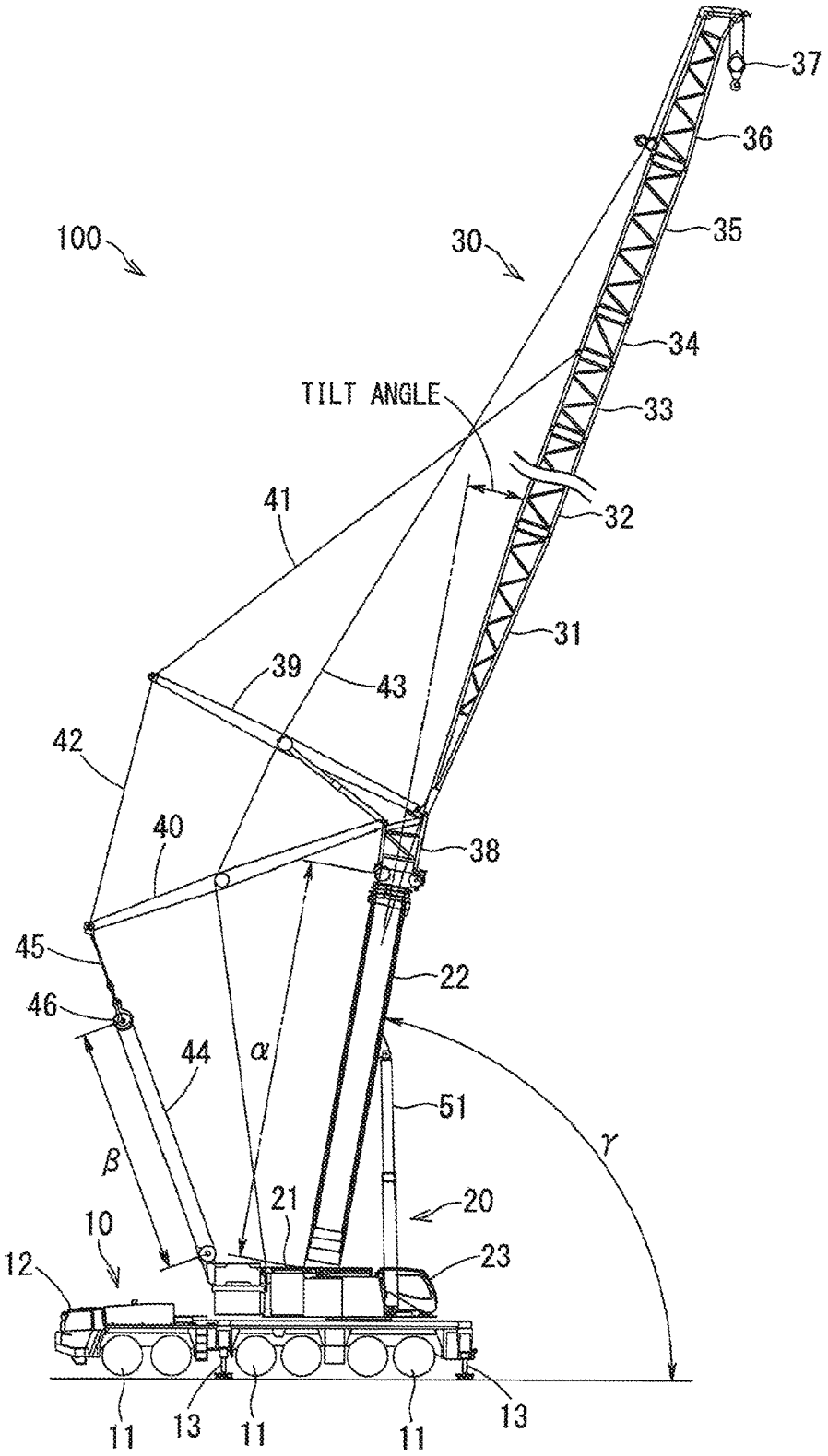
FIG. 1 is a side view of a mobile crane 100 according to an embodiment.

With reference to FIG. 1, a mobile crane 100 according to this embodiment is described. The mobile crane 100 according to this embodiment has a self-propelled base vehicle 10, a crane apparatus 20 mounted on the base vehicle 10, and a luffing jib 30 which is attachable and removable to and from the crane apparatus 20 as illustrated in FIG. 1. The mobile crane 100 illustrated in FIG. 1 is a so-called all terrain crane but described aspects of the design are also applicable to a rough terrain crane and the like.

[Base Vehicle 10]

The base vehicle 10 mainly has a plurality of tires 11, a traveling cabin 12, and outriggers 13 as illustrated in FIG. 1. The base vehicle 10 travels when the tires 11 are rotated by the power of an engine (not illustrated). However, the base vehicle 10 may be one which travels by a caterpillar in place of the tires 11.

The traveling cabin 12 has various operating units (for example, a steering, a shift lever, an accelerator pedal, a brake pedal, and the like) for controlling the traveling of the base vehicle 10. A worker (i.e., driver) getting into the traveling cabin 12 causes the base vehicle 10 to travel by operating the various operating units. The traveling cabin 12 according to this embodiment is not limited to a box shape in which the circumference is surrounded as illustrated in FIG. 1 and may be an open type.

The outriggers 13 stabilize the posture of the mobile crane 100 during the operation of the crane apparatus 20. The outriggers 13 according to this embodiment are provided on both right and left sides at two places in the center and the rear of the base vehicle 10 (only one side is illustrated in FIG. 1). The outriggers 13 can change the state between an extended state in which the outriggers 13 are grounded on the ground at positions extended in the right and left direction from the base vehicle 10 and a housed state in which the outriggers 13 are housed in the base vehicle 10 in the state where the outriggers 13 are separated from the ground.

[Crane Apparatus 20]

The crane apparatus 20 mainly has a slewing base 21, a boom 22, and a crane cabin 23 as illustrated in FIG. 1. The crane apparatus 20 is operated by the power of the engine mounted in the base vehicle 10 transmitted through a hydraulic pressure system (not illustrated).

The slewing base 21 is slewably supported on the base vehicle 10. In more detail, the slewing base 21 is configured so as to be slewable along the slewing plane (typically horizontal surface) on the base vehicle 10. The boom 22 is supported by the slewing base 21 so as to be derrickable and telescopic. In more detail, the boom 22 is configured so as to be raisable and lowerable along the derrick plane (typically vertical plane) orthogonal to the slewing plane and extendable and retractable along the longitudinal direction of the boom 22.

The crane cabin 23 has various operating units (for example, a slewing lever, a derrick lever, an telescopic lever, a winch lever, and the like) for controlling the operation of the crane apparatus 20. A worker (i.e., driver) getting into the crane cabin 23 causes the crane apparatus 20 to operate by operating the various operating units. The crane cabin 23 according to this embodiment is not limited to a box shape in which the circumference is surrounded as illustrated in FIG. 1 and may be an open type.

[Luffing Jib 30]

The luffing jib 30 has a base jib 31, a plurality of intermediate jibs 32, 33, 34, and 35, and a top jib 36 (hereinafter, these jibs may be generically referred to as "divided jibs 31 to 36"). The luffing jib 30 is configured by connecting end portions in the longitudinal direction of the divided jibs 31 to 36. The length of the luffing jib 30 is variable by changing the number of the intermediate jibs 32 to 35. To the tip of the luffing jib 30, a hook 37 locking a hoisted load can be attached.

The luffing jib 30 is derrickably supported by the support 38 attached to the tip of the boom 22. The luffing jib 30 rotatably supports the first mast 39 at an end portion on a side to be connected to the jib support 38. Furthermore, the jib support 38 rotatably supports the second mast 40. However, the first mast may be supported by the jib support 38, without being limited to the luffing jib 30. The luffing jib 30 is configured so as to be derrickable along the same derrick plane as that for the boom 22. The first mast 39 and the second mast 40 are configured so as to be rotatable along the same derrick plane as that for the boom 22 and the luffing jib 30.

The luffing jib 30 and the first mast 39 are connected to each other by a first tension link 41. One end of the first tension link 41 is connected to an intermediate portion (connection portion of the intermediate jibs 33 and 34 in the example of FIG. 1) of the luffing jib 30 and the other end thereof is connected to the tip of the first mast 39. One end of the first tension link 41 may be connected to a tip portion (top jib 36) of the luffing jib 30. The first mast 39 and the second mast 40 are connected to each other by a second tension link 42. One end of the second tension link 42 is connected to the tip of the first mast 39 and the other end thereof is connected to the tip of the second mast 40. The first tension link 41 and the second tension link 42 are configured so as to be bendable, for example.

Figure 2:
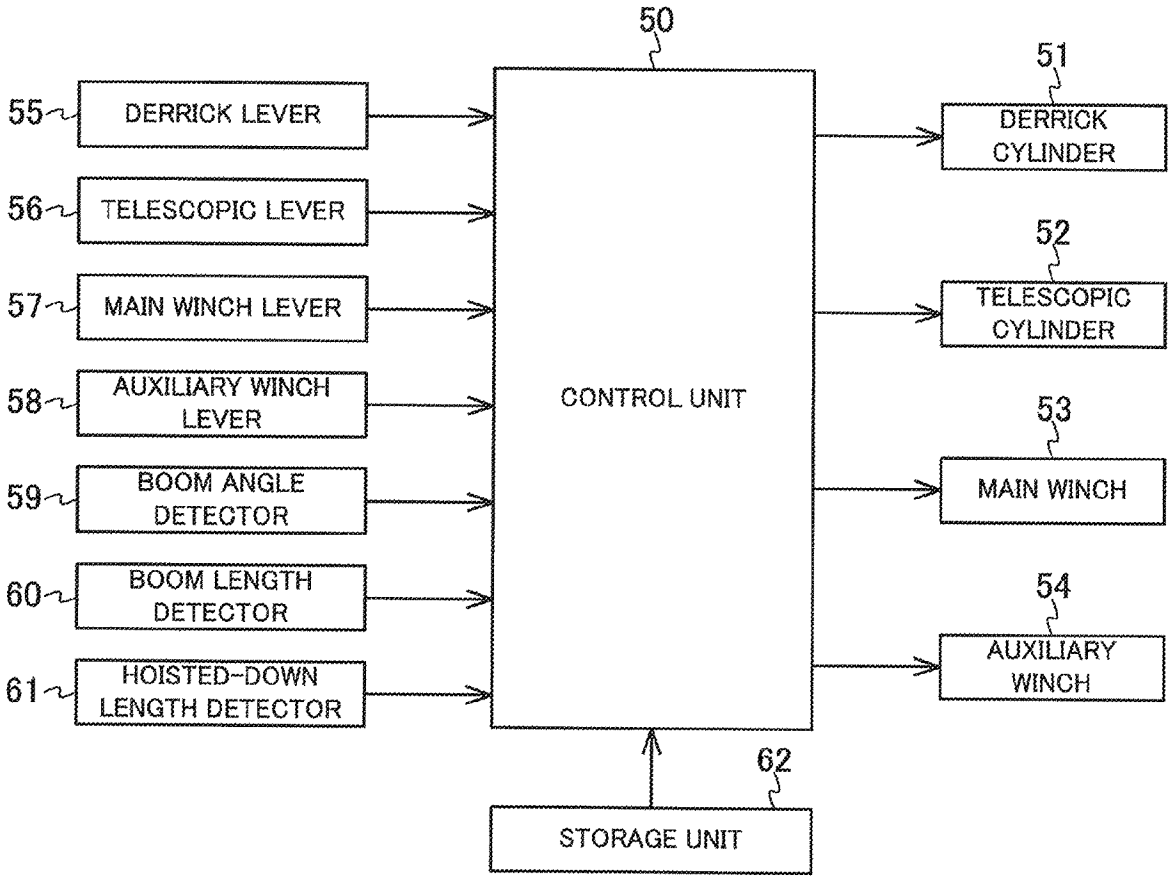
FIG. 2 is a functional block diagram of a crane apparatus 20.

As illustrated in FIG. 2, the crane apparatus 20 further has a control unit 50, a derrick cylinder 51, an telescopic cylinder 52, a main winch 53, an auxiliary winch 54, a derrick lever 55, an telescopic lever 56, a main winch lever 57, an auxiliary winch lever 58, a boom angle detector 59, a boom length detector 60, a hoisted-down length detector 61, and a storage unit 62. The derrick lever 55, the telescopic lever 56, the main winch lever 57, and the auxiliary winch lever 58 are examples of the operating units.

The control unit 50 controls the operation of the crane apparatus 20. The control unit 50 may be realized by a CPU which executes programs stored in the storage unit 62 or may be realized by a relay circuit or an integrated circuit.

The derrick cylinder 51 raises and lowers the boom 22 by hydraulic pressure. In more detail, when the derrick cylinder 51 extends, the boom 22 raises. When the derrick cylinder 51 retracts, the boom 22 falls down. Hereinafter, the angle of the boom 22 to the horizontal surface is defined as a "derrick angle $\gamma$". The telescopic cylinder 52 extends and retracts the boom 22 by hydraulic pressure. In more detail, when the telescopic cylinder 52 extends, the boom 22 extends. When the telescopic cylinder 52 retracts, the boom 22 retracts. Hereinafter, the dimension in the longitudinal direction of the boom 22 is defined as a "boom length $\alpha$".

The main winch 53 hoists down or hoists up a rope 43, the tip of which is connected to the hook 37. When the rope 43 is hoisted down by the main winch 53, the hook 37 moves down. When the rope 43 is hoisted up by the main winch 53, the hook 37 moves up. In the example of FIG. 1, the rope 43 connecting the hook 37 and the main winch 53 to each other is guided by the top jib 36, the first mast 39, and the second mast 40.

The auxiliary winch 54 hoists down or hoists up a rope 44 connected to the second mast 40. When the rope 44 is hoisted down by the auxiliary winch 54, the first mast 39 and the second mast 40 rotate to the luffing jib 30 side and the luffing jib 30 falls down. When the rope 44 is hoisted up by the auxiliary winch 54, the first mast 39 and the second mast 40 rotate to the side opposite to the luffing jib 30 and the luffing jib 30 raises.

In the example of FIG. 1, a connection rod 45 and an air sheave 46 are provided between the second mast 40 and the rope 44. The rope 44 is wound around the auxiliary winch 54 and the air sheave 46 two or more times in order to disperse load. In other words, the rope 44 alternates by n times (n is natural number, for example, n =4.) between the auxiliary winch 54 and the air sheave 46. Hereinafter, the length of the rope 44 hoisted down from the auxiliary winch 54 is defined as a "hoisted-down length $\beta$". The acute angle formed by the boom 22 and the luffing jib 30 is defined as a "tilt angle".

The derrick lever 55 outputs a signal according to a user operation of derrick of the boom 22 to the control unit 50. In more detail, the derrick lever 55 outputs a raise signal to the control unit 50 in response to the reception of a user operation of raising the boom 22. The derrick lever 55 outputs a fall signal to the control unit 50 in response to the reception of a user operation of falling down the boom 22. The control unit 50 extends the derrick cylinder 51 while the raise signal is being output from the derrick lever 55. The control unit 50 retracts the derrick cylinder 51 while the fall signal is being output from the derrick lever 55.

The telescopic lever 56 outputs a signal according to a user operation of extending and retracting the boom 22 to the control unit 50. In more detail, the telescopic lever 56 outputs an extension signal to the control unit 50 in response to the reception of a user operation of extending the boom 22. The telescopic lever 56 outputs a retraction signal to the control unit 50 in response to the reception of a user operation of retracting the boom 22. The control unit 50 extends the telescopic cylinder 52 while the extension signal is being output from the telescopic lever 56. The control unit 50 retracts the telescopic cylinder 52 while the retraction signal is being output from the telescopic lever 56.

The main winch lever 57 outputs a signal according to a user operation of moving up and down the hook 37 to the control unit 50. In more detail, the main winch lever 57 outputs a descent signal to the control unit 50 in response to the reception of a user operation of moving down the hook 37. The main winch lever 57 outputs a raise signal to the control unit 50 in response to the reception of a user operation of moving up the hook 37. The control unit 50 causes the main winch 53 to hoist down the rope 43 while the descent signal is being output from the main winch lever 57. The control unit 50 causes the main winch 53 to hoist up the rope 43 while the raise signal is being output from the main winch lever 57.

The auxiliary winch lever 58 outputs a signal according to a user operation of derrick of the luffing jib 30 to the control unit 50. In more detail, the auxiliary winch lever 58 outputs a fall signal to the control unit 50 in response to the reception of a user operation of causing the luffing jib 30 to fall down. The auxiliary winch lever 58 outputs a raise signal to the control unit 50 in response to the reception of a user operation of raising the luffing jib 30. The control unit 50 causes the auxiliary winch 54 to hoist down the rope 44 while the fall signal is being output from the auxiliary winch lever 58. The control unit 50 causes the auxiliary winch 54 to hoist up the rope 44 while the raise signal is being output from the auxiliary winch lever 58.

The boom angle detector 59 detects the derrick angle of the boom 22, and then outputs the detected angle to the control unit 50. The boom length detector 60 detects the length of the boom 22, and then outputs the detected length to the control unit 50. The hoisted-down length detector 61 detects the hoisted-down length of the rope 44, and then outputs the detected hoisted-down length to the control unit 50. More specifically, the control unit 50 acquires the current value of the derrick angle of the boom 22 from the boom angle detector 59, acquires the current value of the length of the boom 22 from the boom length detector 60, and acquires the current value of the hoisted-down length of the rope 44 from the hoisted-down length detector 61.

The storage unit 62 stores various kinds of information, various programs, and the like required for the control of the crane apparatus 20 by the control unit 50. The storage unit 62 according to this embodiment stores the maximum angle table shown in FIG. 3 and the maximum length table shown in FIG. 4, for example.

The maximum angle table shown in FIG. 3 is a table showing the maximum value of the derrick angle γ (which is hereinafter referred to as the "maximum angle γ") corresponding to each combination of the boom length α and the hoisted-down length β. The maximum angle γ is set to a value at which the second mast 40 does not fall down to the luffing jib 30 side at the corresponding boom length α and the corresponding hoisted-down length β. The maximum angle γ is a value determined in advance by a simulation or an experiment, for example.

In the example of FIG. 3, the hoisted-down length β increases in proportion to an increase in the boom length β. More specifically, when $\alpha 1<\alpha 2<\alpha 3$ is established, $\beta 11<\beta 21<\beta 31$, $\beta 12<\beta 22<\beta 32$, and $\beta 13<\beta 23<\beta 33$ are established. The maximum angle γ decreases with an increase in the hoisted-down length β. More specifically, when $\beta 11<\beta 12<\beta 13$ is established, $\gamma 11>\gamma 12>\gamma 13$ is established. When $\beta 21<\beta 22<\beta 23$ is established, $\gamma 21>\gamma 22>\gamma 23$ is established. When $\beta 31<\beta 32<\beta 33$ is established, $\gamma 31>\gamma 32>\gamma 33$ is established.

The maximum length table shown in FIG. 4 is a table showing the maximum value of the hoisted-down length β (hereinafter referred to as the "maximum length β") corresponding to each combination of the boom length α and the derrick angle γ. The maximum length β is set to a value at which the second mast 40 does not fall down to the luffing jib 30 side at the corresponding boom length α and the corresponding derrick angle γ. The maximum length β is a value determined in advance by a simulation or an experiment, for example.

In the example of FIG. 4, the maximum length β increases in proportion to an increase in the boom length α. More specifically, when $\alpha 4<\alpha 5<\alpha 6$ is established, $\beta 41<\beta 51<\beta 61$, $\beta 42<\beta 52<\beta 62$, and $\beta 43<\beta 53<\beta 63$ are established. The maximum length β decreases with an increase in the derrick angle γ. More specifically, when $\gamma 41<\gamma 42<\gamma 43$ is established, $\beta 41>\beta 42>\beta 43$ is established. When $\gamma 51<\gamma 52<\gamma 53$ is established, $\beta 51>\beta 52>\beta 53$ is established. When $\gamma 51<\gamma 52<\gamma 53$ is established, $\beta 51>\beta 52>\beta 53$ is established.

In FIG. 3 and FIG. 4, values between 10 m to 30 m are set for the boom length α, values between 150 m to 450 m are set for the hoisted-down length β, and values between 0° to 90° are set for the derrick angle γ. In some of the inequality sings, "<" can be replaced by "≤" and ">" can be replaced by "≥".

[Method for Assembling Luffing Jib 30]

Figure 5:
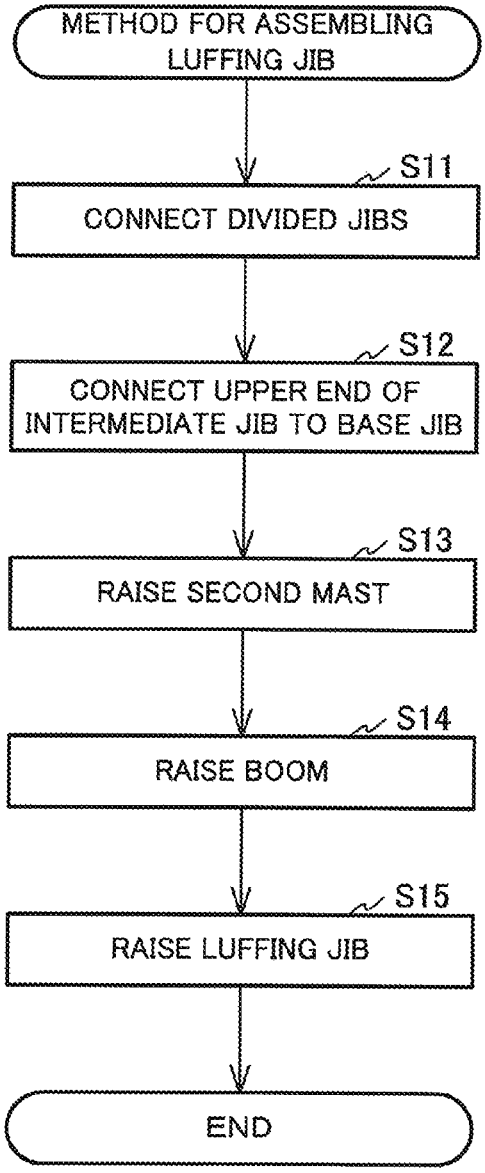
FIG. 5 is a flow chart showing a method for assembling a luffing jib 30.
Figure 6:
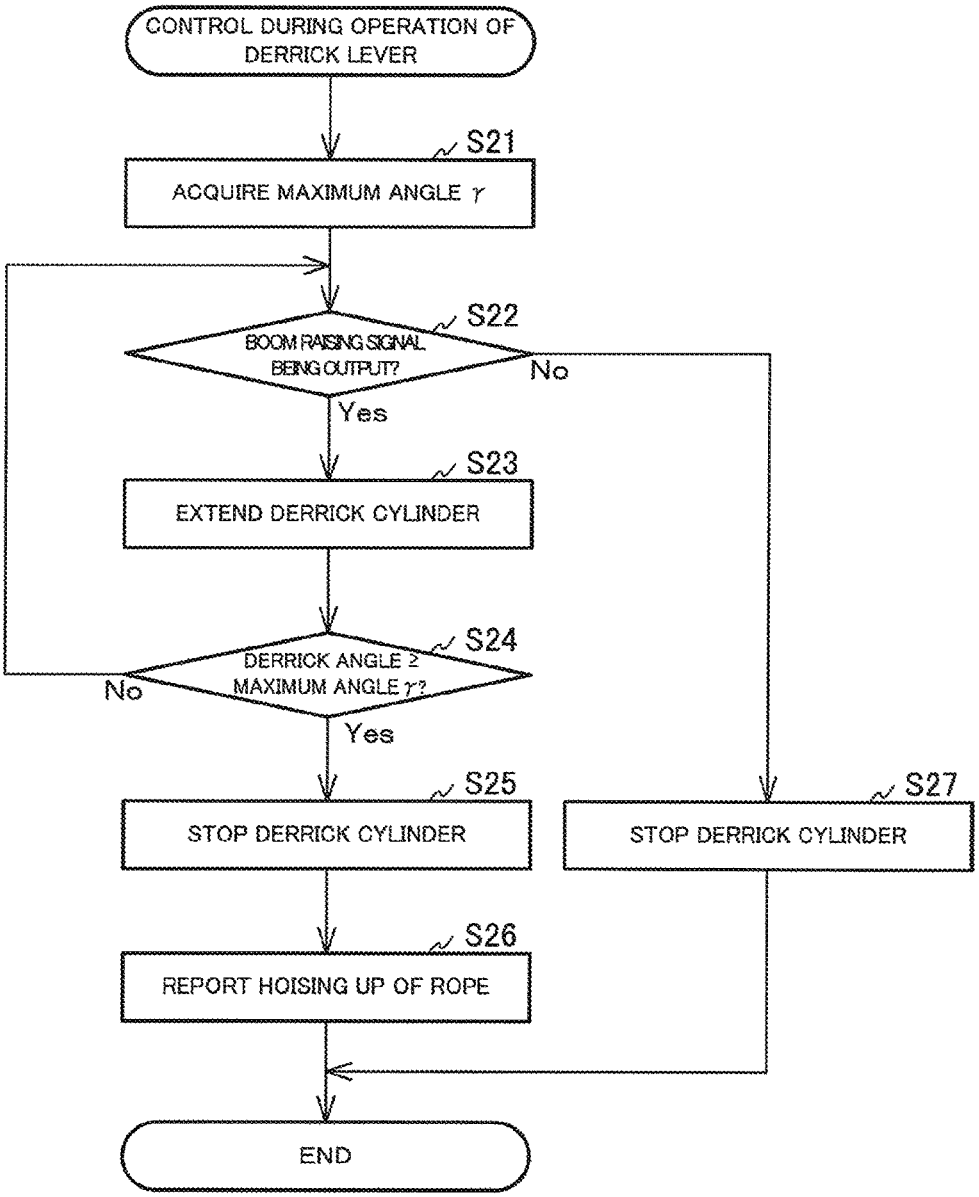
FIG. 6 is a flow chart showing processing in operating a derrick lever 55.
Figure 7:
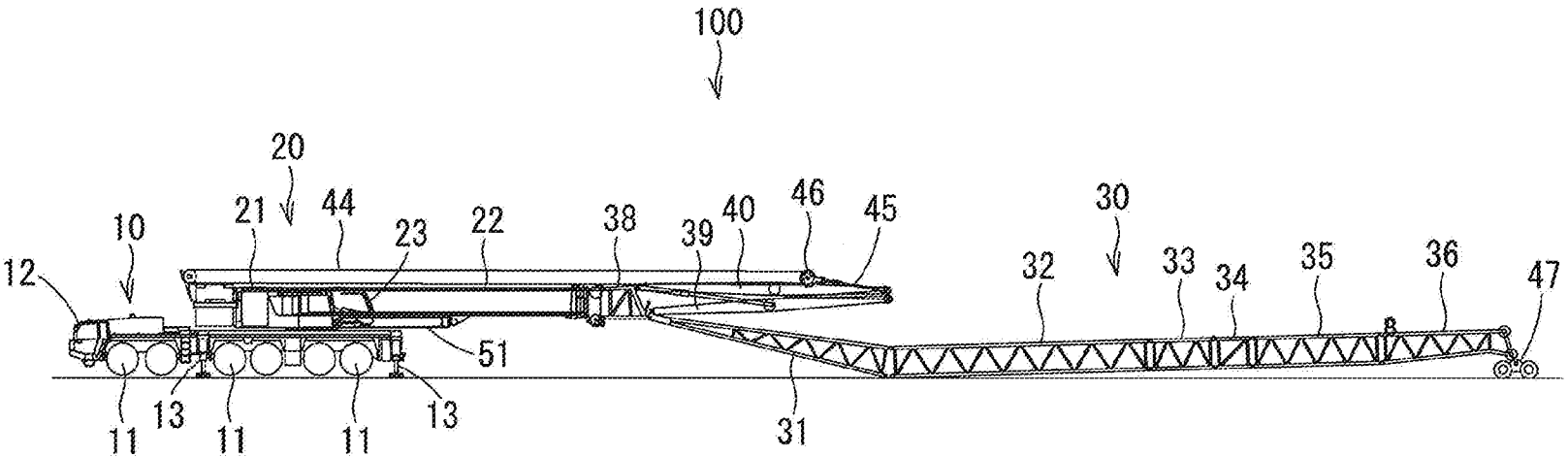
FIG. 7 is a view illustrating a state in which the upper end of a base jib 31 is connected to a jib support 38.
Figure 8:
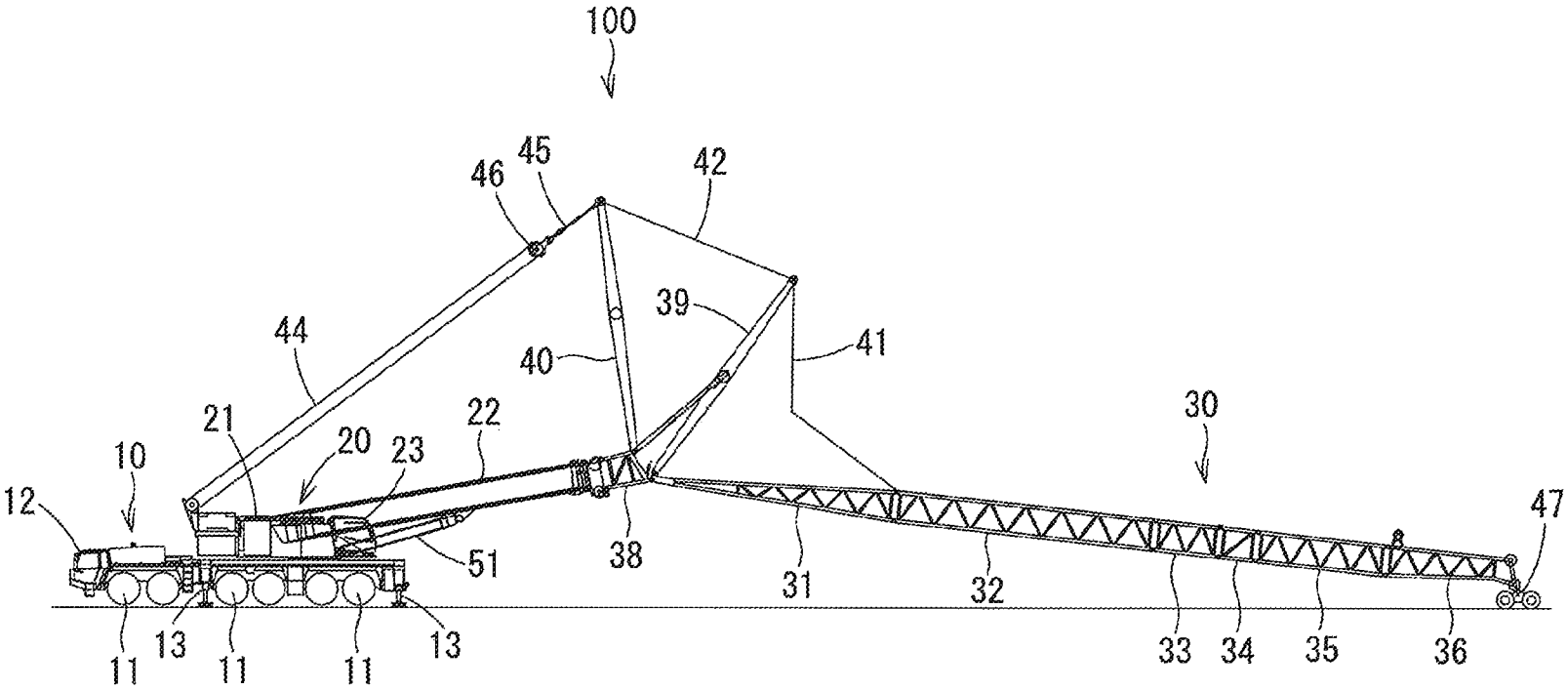
FIG. 8 is a view illustrating a state where a second mast 40 is raised.
Figure 9:
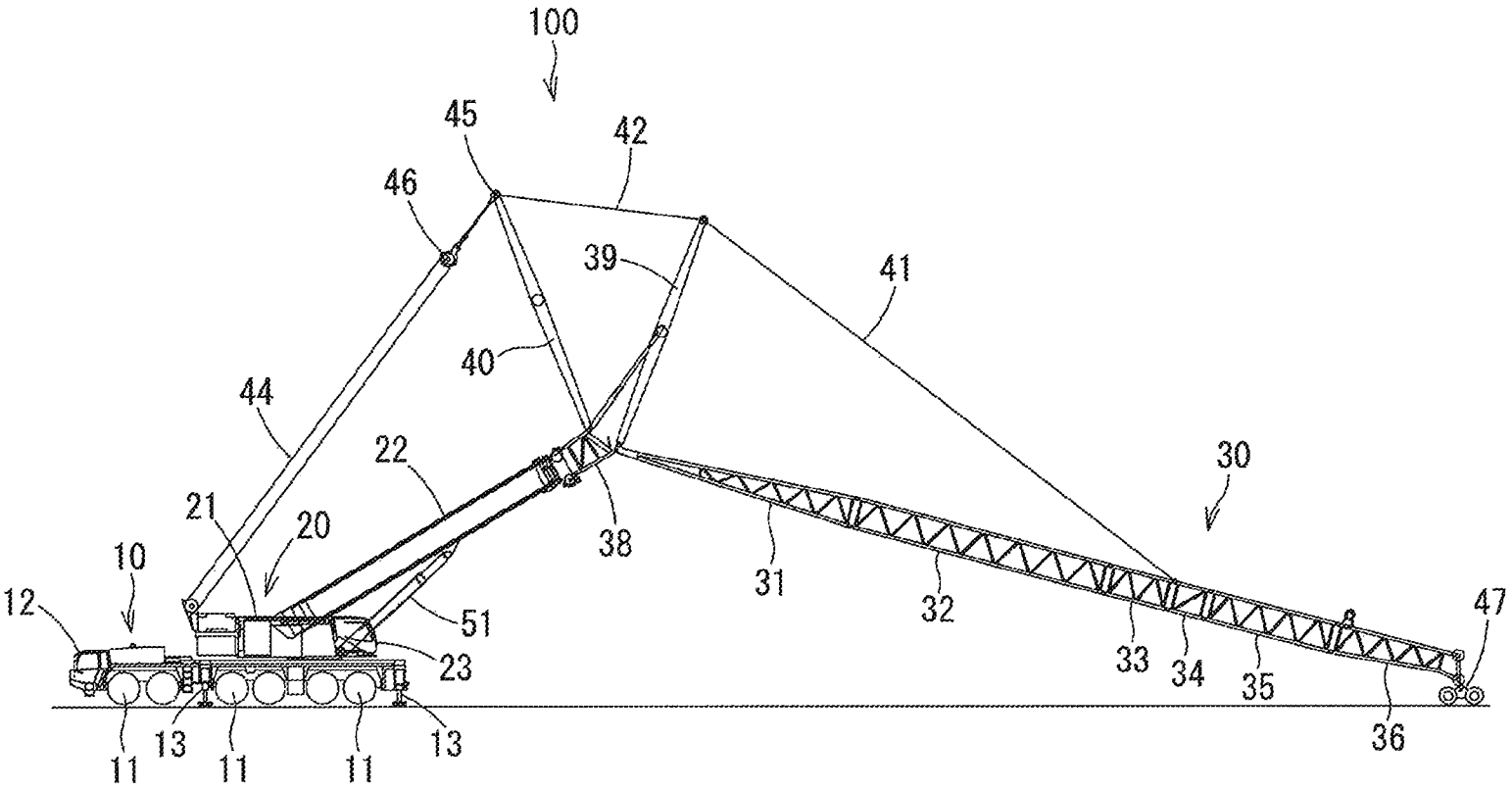
FIG. 9 is a view illustrating a state where a boom 22 is being raised.

A method for assembling the luffing jib 30, the luffing jib 30 which is attached to the mobile crane 100, is described with reference to FIG. 5 to FIG. 9. FIG. 5 is a flow chart showing the procedure of the method for assembling the luffing jib 30. FIG. 6 is a flow chart showing the control contents of the control unit 50 in Step S14. FIG. 7 to FIG. 9 are views illustrating the state of the mobile lane 100 in processes of assembling the luffing jib 30.

First, a worker assembles the luffing jib 30 by connecting end portions in the longitudinal direction of the divided jibs 32 to 36 as illustrated in FIG. 7 (S11). The assembled luffing jib 30 is placed on the ground in a fallen-down state. To the tip of the top jib 36, a truck 47 is attached. On the other hand, the base jib 31 is integrally configured with the jib support 38 attached to the tip of the boom 22, and therefore the base jib 31 is separated from the intermediate jib 32 in Step S11.

Next, a worker connects the upper end of the intermediate jib 32 to the base jib 31 (S12). The second tension link 42 is connected to the first mast 39 and the second mast. The rope 44 extended from the auxiliary winch 54 is connected to the second mast 40 through the connection rod 45 and the air sheave 46. The second mast 40 illustrated in FIG. 7 is fallen-down to the luffing jib 30 side. However, the luffing jib 30 having a small tilt angle is not damaged by the fallen-down second mast 40 as illustrated in FIG. 7.

Next, a worker raises the second mast 40 as illustrated in FIG. 8 (S13). The raise of the second mast 40 is performed by operating the auxiliary winch lever 58. Specifically, the control unit 50 causes the auxiliary winch 54 to hoist up the rope 44 in response to a raise signal output from the auxiliary winch lever 58 operated by the worker. In the process in which the second mast 40 is raised, the lower end of the intermediate jib 32 is connected to the base jib 31 and the first tension link 41 is connected to the luffing jib 30 and the first mast 39.

The second mast 40 is raised so that sufficient tension is applied to the second tension link 42 and the rope 44. The second mast 40 according to this embodiment is raised so as to form an angle of 90° to the horizontal surface. More specifically, a worker ends the user operation of raising the second mast 40 in response to the angle of the second mast 40 to the horizontal surface reaching 90°.

Figure 11:
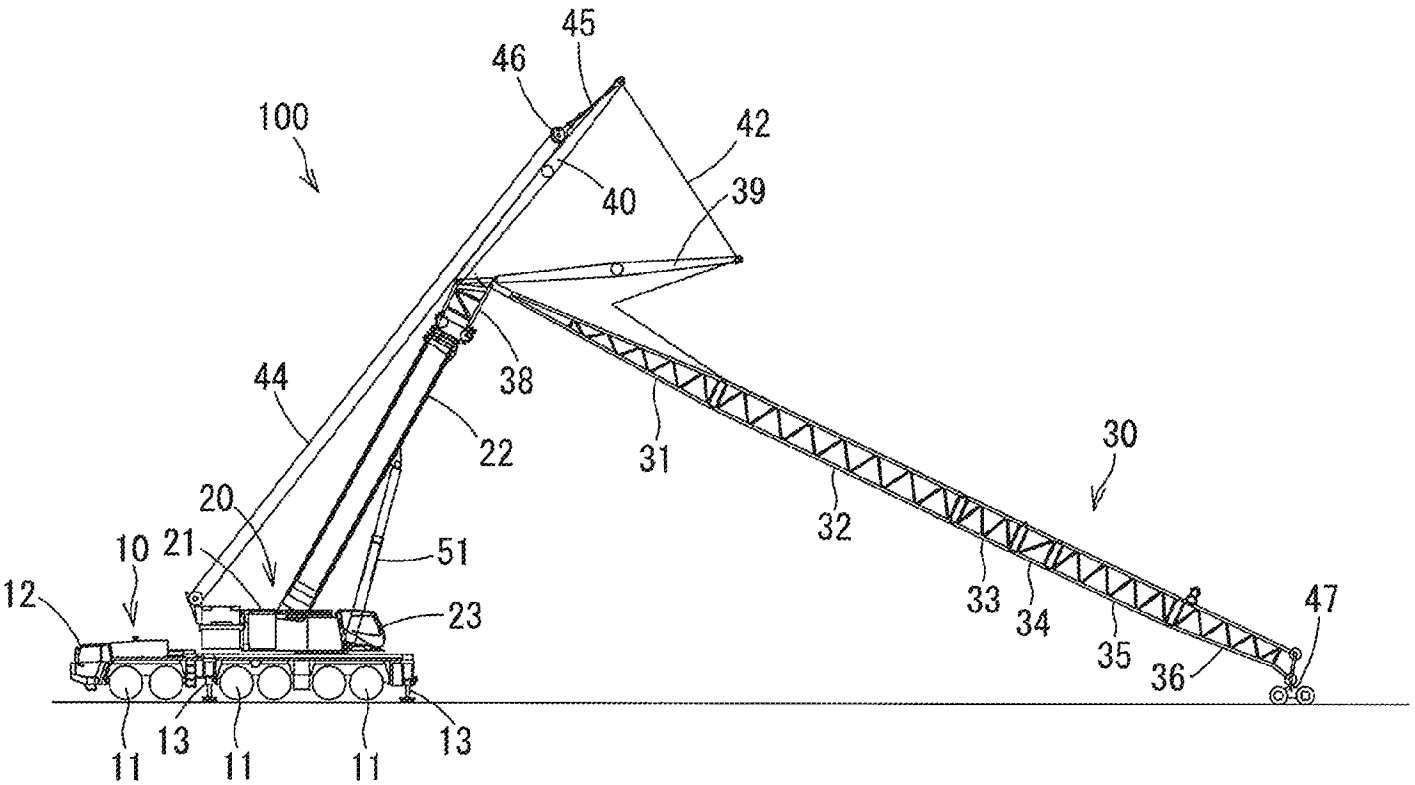
FIG. 11 is a view illustrating a state where the boom 22 is raised in a state where a second mast 40 is not sufficiently raised.
Figure 12:
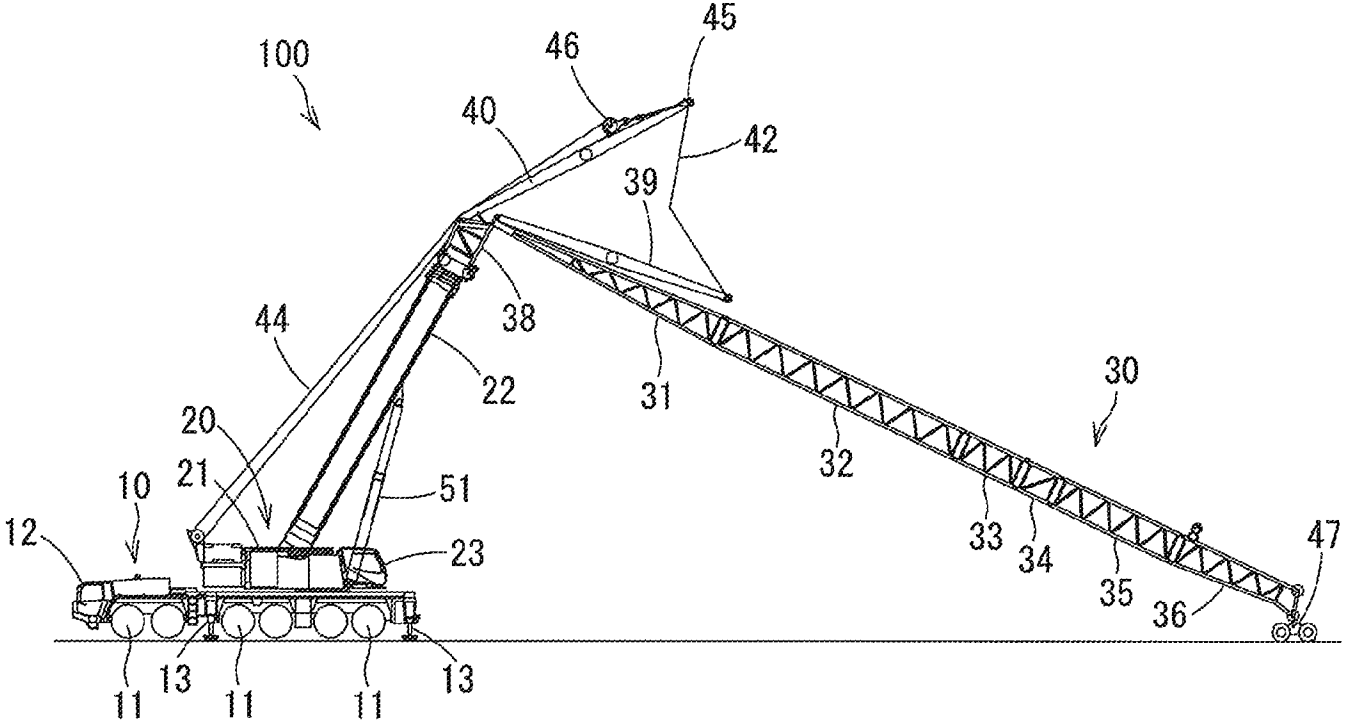
FIG. 12 is a view illustrating a state where the second mast 40 falls down to the luffing jib 30 side.

Next, a worker raises the boom 22 (S14). The raise of the boom 22 is performed by operating the derrick lever 55. When the second mast 40 is sufficiently raised in Step S13, the boom 22 is raised in a state where the angle formed by the second mast 40 and the rope 44 is maintained at a safe angle as illustrated in FIG. 9. On the other hand, when the boom 22 is raised in a state where the second mast 40 is not sufficiently raised in Step S13, the angle formed by the second mast 40 and the rope 44 approaches 0° as illustrated in FIG. 11.

Herein, the control unit 50 does not monitor whether the second mast 40 is sufficiently raised at the start point of Step S14, and thus a worker needs to confirm whether the second mast 40 is sufficiently raised. More specifically, there is a possibility that, before the second mast 40 is sufficiently raised, the hoisting up of the rope 44 by the auxiliary winch 54 is ended due to carelessness of a worker and the like, so that Step S14 is carried out, for example. Then, the control unit 50 performs processing shown in FIG. 6 in response to a raise signal output from the derrick lever 55 operated by the worker.

First, the control unit 50 acquires the maximum angle γ from the storage unit 62 (S21). Specifically, the control unit 50 acquires the current boom length α from the boom length detector 60 and acquires the current hoisted-down length β from the hoisted-down length detector 61. Then, the control unit 50 reads out the maximum angle γ corresponding to the acquired boom length α and the acquired hoisted-down length β from the maximum angle table shown in FIG. 3.

Next, the control unit 50 extends the derrick cylinder 51 in response to a raise signal output from the derrick lever 55 (S22: Yes) (S23). The control unit 50 acquires the current derrick angle of the boom 22 from the boom angle detector 59 in Step S23. Then, the control unit 50 repeatedly performs the processing of Step S22 and the processing of S23 until the acquired derrick angle of the boom 22 reaches the maximum angle γ (S24: No). More specifically, the control unit 50 continuously extends the derrick cylinder 51 when a raise signal is output from the derrick cylinder 51 and until the derrick angle of the boom 22 reaches the maximum angle γ.

Then, the control unit 50 stops the derrick cylinder 51 in response to the acquired derrick angle of the boom 22 reaching the maximum angle γ (S24: Yes), irrespective of whether a raise signal is output from the derrick lever 55 (S25). The control unit 50 reports that it is necessary to hoist up the rope 44 to raise the second mast 40 (S26). Although a specific report method is not particularly limited, a message may be displayed on a display device (not illustrated) placed in the crane cabin 23 or a warning sound may be output through a speaker (not illustrated). For example, when Step S14 is performed in the state where the second mast 40 is not sufficiently raised as illustrated in FIG. 11, Steps S25 and S26 may be performed.

On the other hand, the control unit 50 stops the derrick cylinder 51 according to the fact that the output of the raise signal from the derrick lever 55 is suspended (S22: No) before the derrick angle of the boom 22 reaches the maximum angle γ (S27). A worker ends the user operation of raising the boom 22 in response to the derrick angle of the boom 22 reaching 80°, for example. In the process in which the boom 22 is raised, the truck 47 is removed from the top jib 36, and then the hook 37 is attached to the rope 43 extended to the tip of the top jib 36. For example, when Step S14 is performed in the state where the second mast 40 is sufficiently raised as illustrated in FIG. 9, the boom 22 can be raised until the derrick angle reaches 80°.

Next, a worker raises the luffing jib 30 as illustrated in FIG. 1 (S15). The raise of the luffing jib 30 is performed by operating the auxiliary winch lever 58. Specifically, the control unit 50 causes the auxiliary winch 54 to hoist up the rope 44 in response to a raise signal output from the auxiliary winch lever 58 operated by the worker. Then, the worker ends the user operation of raising the luffing jib 30 in response to the tilt angle of the luffing jib 30 reaching 10°, for example.

[Operational Effects of Embodiment]

According to the embodiment described above, the derrick cylinder 51 is stopped in response to the derrick angle of the boom 22 reaching the maximum angle γ, irrespective of whether the derrick lever 55 is operated. More specifically, the boom 22 is prevented from being raised exceeding the maximum angle γ corresponding to the boom length α and the hoisted-down length β. As a result, the luffing jib 30 can be prevented from being damaged by the second mast 40 falling down to the luffing jib 30 side.

According to the embodiment described above, in addition to the fact that the derrick cylinder 51 is stopped, it is also reported to a worker that the rope 44 needs to be hoisted up. More specifically, since an operation for avoiding the fall down of the second mast 40 can be urged to a worker, damages to the luffing jib 30 can be more effectively suppressed.

According to the method for assembling the luffing jib 30 of the embodiment described above, an example of so-called "flat assembling" is described but is also applicable to so-called "vertical assembling". The timing when the processing of FIG. 6 is performed is not particularly limited to the timing of Step S14 of FIG. 5. For example, the processing shown in FIG. 6 may be performed when the boom 22 and the luffing jib 30 are raised in order to lock a hoisted load with the hook 37 or in order to move a hoisted load locked with the hook 37 to a desired position. Thus, the second mast 40 is prevented from falling down to the luffing jib 30 side during the operation of the crane apparatus 20.

Figure 10:
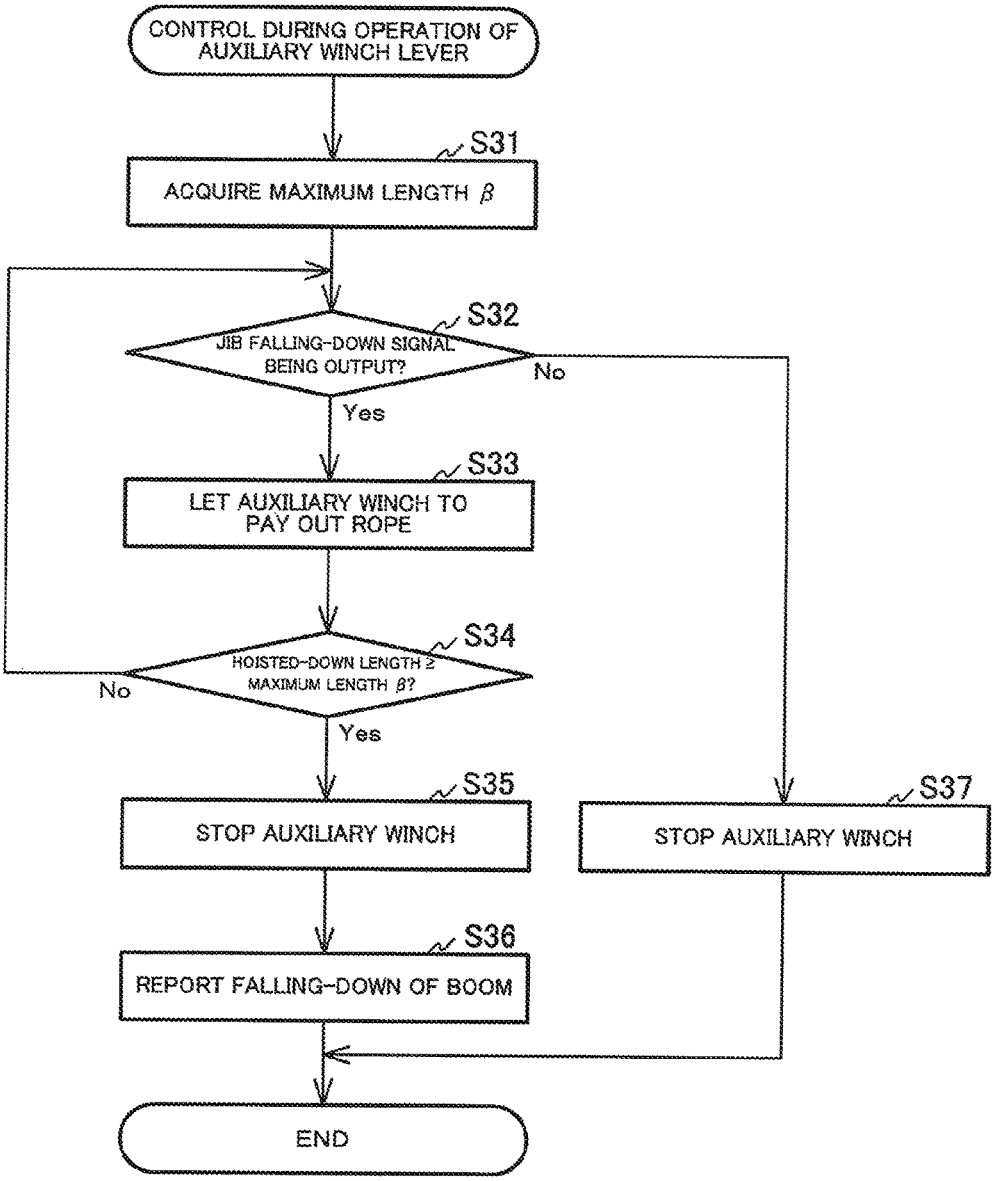
FIG. 10 is a flow chart showing processing in operating an auxiliary winch lever 58.

The processing of the control unit 50 for preventing the second mast 40 from falling down to the luffing jib 30 side is not particularly limited to FIG. 6 and may be processing shown in FIG. 10, for example. The control unit 50 performs processing shown in FIG. 10 in response to the reception of a user operation of causing the auxiliary winch 54 to hoist down the rope 44 by the auxiliary winch lever 58 (i.e., a fall signal is output from the auxiliary winch lever 58).

First, the control unit 50 acquires the maximum length β from the storage unit 62 (S31). Specifically, the control unit 50 acquires the current boom length α from the boom length detector 60 and acquires the current derrick angle γ from the boom angle detector 59. Then, the control unit 50 reads out the maximum length β corresponding to the acquired boom length α and the acquired derrick angle γ from the maximum length table shown in FIG. 4.

Next, the control unit 50 causes the auxiliary winch 54 to hoist down the rope 44 in response to a fall signal output from the auxiliary winch lever 58 (S32: Yes) (S33). The control unit 50 acquires the current hoisted-down length of the rope 44 from the hoisted-down length detector 61 in Step S33. Then, the control unit 50 repeatedly performs the processing of Step S32 and the processing of S33 until the acquired hoisted-down length of the rope 44 reaches the maximum length β (S34: No). More specifically, the control unit 50 causes the auxiliary winch 54 to continuously hoist down the rope 44 when a fall signal is output from the auxiliary winch lever 58 and until the hoisted-down length of the rope 44 reaches the maximum length β.

Then, the control unit 50 stops the auxiliary winch 54 in response to the acquired hoisted-down length of the rope 44 reaching the maximum length β (S34: Yes), irrespective of whether a fall signal is output from the auxiliary winch lever 58 (S35). The control unit 50 reports that it is necessary to make the boom 22 fall down by retracting the derrick cylinder 51 (S36). A specific report method may be the same as that of Step S26. On the other hand, the control unit 50 stops the auxiliary winch 54 according to the fact that the output of the fall signal from the auxiliary winch lever 58 is suspended (S32: No) before the hoisted-down length of the rope 44 reaches maximum length β (S37).

According to the processing described above, the rope 44 is prevented from being hoisted down from the auxiliary winch 54 exceeding the maximum length β corresponding to the boom length α and the derrick angle γ. As a result, the luffing jib 30 can be prevented from being damaged by the second mast 40 falling down to the luffing jib 30 side. The processing shown in FIG. 10 may be performed when the luffing jib 30 is removed from the mobile crane 100 or may be performed when the boom 22 and the luffing jib 30 are raised in order to lock a hoisted load with the hook 37 or in order to move the hoisted load locked with the hook 37 to a desired position, for example.

The invention claimed is:

1. A mobile crane comprising:

a base vehicle;

a slewing base slewably supported by the base vehicle;

a boom derrickably supported by the slewing base;

a derrick cylinder raising and lowering the boom;

a jib support removably attached to a tip of the boom;

a luffing jib derrickably supported by the jib support;

a first mast rotatably supported by the jib support or the luffing jib;

a second mast rotatably supported by the jib support;

a first tension link connecting the luffing jib and the first mast to each other;

a second tension link connecting the first mast and the second mast to each other;

a winch hoisting down a rope connected to the second mast to rotate the second mast to a side of the luffing jib and hoisting up the rope to rotate the second mast to a side opposite to the luffing jib;

an operating unit outputting a signal according to a user operation of derrick of the boom; and a control unit controlling an operation of the derrick cylinder and the winch, wherein the control unit causes the derrick cylinder to raise the boom in response to a signal output from the operating unit and stops the derrick cylinder in response to a derrick angle of the boom reaching a maximum angle corresponding to a hoisted-down length of the rope.

2. The mobile crane according to claim 1, wherein the control unit reports that it is necessary to hoist up the rope in response to the derrick angle of the boom reaching a maximum angle.

3. The mobile crane according to claim 1 further comprising:

a storage unit storing the maximum angle set for each hoisted-down length of the rope.

4. The mobile crane according to claim 1, wherein the boom is telescopic, and the control unit stops the derrick cylinder in response to the derrick angle of the boom reaching the maximum angle corresponding to a combination of the hoisted-down length of the rope and a length of the boom.

5. A mobile crane comprising:

a base vehicle;

a slewing base slewably supported by the base vehicle;

a boom derrickably supported by the slewing base;

a derrick cylinder raising and lowering the boom;

a jib support removably attached to a tip of the boom;

a luffing jib derrickably supported by the jib support;

a first mast rotatably supported by the jib support or the luffing jib;

a second mast rotatably supported by the jib support;

a first tension link connecting the luffing jib and the first mast to each other;

a second tension link connecting the first mast and the second mast to each other;

a winch hoisting down a rope connected to the second mast to rotate the second mast to a side of the luffing jib and hoisting up the rope to rotate the second mast to a side opposite to the luffing jib;

an operating unit outputting a signal according to a user operation of hoisting down the rope; and a control unit controlling an operation of the derrick cylinder and the winch, wherein the control unit causes the winch to hoist down the rope in response to a signal output from the operating unit and stops the winch in response to a hoisted-down length of the rope reaching a maximum length corresponding to a derrick angle of the boom.

6. The mobile crane according to claim 5, wherein the control unit reports that it is necessary to make the boom fall down in response to the hoisted-down length of the rope reaching a maximum length.

7. The mobile crane according to claim 5 further comprising:

a storage unit storing the maximum length set for each derrick angle of the boom.

8. The mobile crane according to claim 5, wherein the boom is telescopic, the control unit stops the winch in response to the hoisted-down length of the rope reaching a maximum length corresponding to a combination of the derrick angle of the boom and a length of the boom.

* * * * *